US009038747B2

(12) United States Patent
Abney et al.

(10) Patent No.: US 9,038,747 B2
(45) Date of Patent: May 26, 2015

(54) ADJUSTABLE BENT DRILLING TOOL HAVING IN SITU DRILLING DIRECTION CHANGE CAPABILITY

(75) Inventors: David Abney, Rowlett, TX (US); Morgan Crow, Ovilla, TX (US); Anthony C. Muse, Terrell, TX (US); Andre Orban, Sugar Lane, TX (US); Stan Weise, Waxahachie, TX (US)

(73) Assignee: David L. Abney, Inc., Seagoville, TX (US)

( * ) Notice: Subject to any disclaimer, the term of this patent is extended or adjusted under 35 U.S.C. 154(b) by 356 days.

(21) Appl. No.: 13/528,591

(22) Filed: Jun. 20, 2012

(65) Prior Publication Data

US 2013/0153297 A1 Jun. 20, 2013

Related U.S. Application Data

(60) Provisional application No. 61/498,879, filed on Jun. 20, 2011.

(51) Int. Cl.

| | |
|---|---|
| ***E21B 7/04*** | (2006.01) |
| ***E21B 7/06*** | (2006.01) |
| ***E21B 17/02*** | (2006.01) |

(52) U.S. Cl.

CPC . *E21B 7/04* (2013.01); *E21B 7/067* (2013.01); *E21B 17/02* (2013.01)

(58) Field of Classification Search

CPC ..... E21B 7/067
USPC ..... 166/330, 331; 175/73–75, 61
See application file for complete search history.

(56) References Cited

U.S. PATENT DOCUMENTS

| | | | |
|---|---|---|---|
| 1,464,386 | A | 8/1923 | Ingram |
| 2,076,845 | A | 4/1937 | Howard et al. |
| 2,645,513 | A | 7/1953 | Sterrett |
| 2,890,073 | A | 6/1959 | Thomas |
| 3,084,751 | A | 4/1963 | Scarborough |
| 3,203,716 | A | 8/1965 | Lannen |
| 4,293,148 | A | 10/1981 | Milberger |
| 4,427,221 | A | 1/1984 | Shay, Jr. |
| 4,697,947 | A | 10/1987 | Bauer et al. |

(Continued)

FOREIGN PATENT DOCUMENTS

| | | | |
|---|---|---|---|
| WO | 93/10326 | A1 | 5/1993 |
| WO | 2004065835 | A2 | 8/2004 |

*Primary Examiner* — Kenneth L Thompson
*Assistant Examiner* — Steven MacDonald
(74) *Attorney, Agent, or Firm* — John G. Fischer, Esq.; Scheef & Stone, L.L.P.

(57) ABSTRACT

An adjustable bent drilling tool capable of changing in situ drilling direction to facilitate horizontal drilling. The drilling tool may be controlled from the surface and eliminates the need to bring the tool to the surface for reconfiguration. In one embodiment, the drilling tool utilizes a communications module to communicate with upstream sections of the tool. The communications module is connected to a programmable electronic control module which controls an electric motor. A hydraulic valve assembly follows the control module, which receives input signals and controls a pilot piston between two fixed points of a mid-assembly typically located adjacent to and downstream of the hydraulic valve assembly on the drill tool. A lower assembly is attached to the drill tool immediately following the mid-assembly, and provides both a safety release sub-assembly as well as a bendable sub-assembly which directs the adjustable drill tool to change drilling angle and direction.

21 Claims, 17 Drawing Sheets

(56) References Cited

U.S. PATENT DOCUMENTS

| | | | |
|---|---|---|---|
| 4,749,192 | A | 6/1988 | Howeth |
| 5,220,963 | A | 6/1993 | Patton |
| 5,286,135 | A | 2/1994 | James |
| 6,092,610 | A | 7/2000 | Kosmala et al. |
| 6,158,529 | A | 12/2000 | Dorel |
| 6,179,347 | B1 | 1/2001 | Dole et al. |
| 6,234,259 | B1 | 5/2001 | Kuckes et al. |
| 6,394,193 | B1 | 5/2002 | Askew |
| 6,427,783 | B2 | 8/2002 | Krueger et al. |
| 6,439,325 | B1 | 8/2002 | Peters et al. |
| 6,484,818 | B2 | 11/2002 | Alft et al. |
| 6,513,606 | B1 | 2/2003 | Krueger |
| 6,561,289 | B2 | 5/2003 | Portman et al. |
| 6,739,629 | B2 | 5/2004 | Riedy et al. |
| 6,942,044 | B2 | 9/2005 | Moore et al. |
| 7,195,083 | B2 | 3/2007 | Eppink et al. |
| 7,287,604 | B2 | 10/2007 | Aronstam et al. |
| 7,377,333 | B1 | 5/2008 | Sugiura |
| 7,383,897 | B2 | 6/2008 | Moody et al. |
| 7,404,454 | B2 | 7/2008 | Hulick |
| 7,413,032 | B2 | 8/2008 | Krueger |
| 7,426,967 | B2 | 9/2008 | Sugiura |
| 7,464,770 | B2 | 12/2008 | Jones et al. |
| 7,571,643 | B2 | 8/2009 | Sugiura |
| 7,725,263 | B2 | 5/2010 | Sugiura |
| 7,757,782 | B2 | 7/2010 | Tashiro et al. |
| 7,823,655 | B2 | 11/2010 | Boone et al. |
| 7,861,802 | B2 | 1/2011 | Underwood et al. |
| 7,866,414 | B2 | 1/2011 | Patel |
| 2007/0151767 | A1 | 7/2007 | Downton |
| 2007/0246936 | A1 | 10/2007 | Jeltsch |
| 2011/0127044 | A1 | 6/2011 | Radford et al. |

ADJUSTABLE BENT DRILLING TOOL HAVING IN SITU DRILLING DIRECTION CHANGE CAPABILITY

BACKGROUND

1. Field of the Invention

The technology relates to drill tools used for drilling into geological structures, including but not limited to potential hydrocarbon-bearing structures, and more particularly to drill tools that include an assembly that has capability for a controlled change in the direction of drilling in situ.

2. Description of the Related Art

In the field of drilling technology, it has become well known to drill a bore vertically to a predetermined or selected depth. In one aspect of drilling technology, it is known to drill the borehole at a deviated angle from vertical. This form of drilling is known as "directional" drilling, which creates boreholes that approach a horizontal deviation. This is done by drilling down in the traditional sense, and then gradually curving the direction of drilling until a substantially horizontal drilling plane is achieved to enter a region that has or is believed to have a reservoir of a desired product, often hydrocarbons such as oil and/or gas. A purpose for drilling a horizontal deviation across an oil or hydrocarbon producing region is to increase production from a reservoir, or for some other reason. To drill these multiple horizontal bores, it has been necessary to reconfigure the drill tool for each new horizontal drilling operation. Such a process is necessarily slow and laborious, and necessitates bringing the drill string to the surface for manual adjustment at regular intervals. Not only is such a procedure time consuming and prone to substantial delays, but also increases unnecessary wear on drilling equipment during the reconfiguration process, thereby substantially increasing the cost for the production of in-situ fluids. In general, the adage "time is money" applies to drilling operations where drilling rigs may be billed on a time-basis by the operator and/or owner. Therefore, there is a need for a more expedient and efficient method for horizontal drilling in-situ without necessitating that the drill tool be constantly reconfigured or brought back to the surface for adjustments.

SUMMARY

In an exemplary embodiment, the drilling tool assembly has a capability to make a change in the direction of drilling, in situ while underground in a controlled manner, and under control from the surface. This eliminates the need to bring the entire drill string up to the surface for manual reconfiguration.

In another exemplary embodiment, the drill tool assembly may be provided that has a series of related modules: a startup module, an electronics control module with associated battery and electric motor, a hydraulic valve assembly module, a mid-assembly module which includes a J-slot of particular design, a lower assembly module that includes a release sleeve safety feature that permits "unbending" and retrieval of string in the event of mechanical necessity, and a bending sub-assembly module that includes a mechanical camming feature that "bends" and causes redirection of the drilling tool, as well as the drill bit and drill string.

An exemplary startup module communicates back and forth with both upstream controls at the surface as well as downstream sections of the drill tool. The startup module includes a sensor that senses pulses in a hydraulic fluid that indicate command signals. Upon receiving an appropriate command signal, the startup module activates the electronics control module. In an exemplary embodiment, the startup module may include a pressure sensor that senses pulses in a hydraulic fluid that may be used as a communications medium.

An exemplary electronics control module may include a central processing unit ("CPU") chip in communication with a solid state memory and a battery. The CPU is programmable and carries out selected calculations and controls an electric motor. The memory stores data, including J-slot position, measurements while drilling data ("MWD"), and the like, which the CPU may utilize, as needed in its calculations. Moreover, the electronics control module is able to communicate with the startup module to receive an activation signal. Many of the electronic components, the CPU and memory, for example, may be mounted onto a circuit board for convenience and protection. The battery may include rechargeable batteries, such as lithium ion-type batteries, although others may also be used. The electronic module also may include and control an electric motor that motivates a control piston to reciprocate in a controlled manner with respect to the extent of stroke advance or retreat. The extent of the stroke of the control piston within a hydraulic manifold controls flow of hydraulic fluid in the hydraulic valve assembly module, which in turn controls the change in direction of the drilling, as explained below and shown in the drawings.

An exemplary mid-assembly module, which may include a hydraulic manifold, effectively transmits and carries out the electronic command signal from the electronic module via hydraulics that are used to reciprocate a pilot piston between two fixed points of the mid-assembly module. The motion of the pilot piston, and the directed flow of hydraulic fluid, causes a J-slot of particular exemplary design to rotate. In an exemplary embodiment, a single complete revolution of the pilot piston (from start position back to start position) advances or turns to J-slot such that the drill tool bends by a preset number of degrees, for example 1 (one) degree, as explained further here below. The J-slot motion and position may be tracked by magnetic sensors using magnets attached to the J-slot that move with it and at least one magnet that is fixed and does not move with the J-slot. The stationary magnet has a known magnetic field relative to a predetermined position of the J-slot. Thus, as the J-slot rotates, the magnetic field of magnets attached to it interacts with the magnetic field of the stationary magnet. This interaction permits accurate determination of the position of the J-slot (and hence the degree of bending of the bendable sub-assembly). This information may be transmitted to the electronics control module and back to the surface via the startup and communications module, or another method, such as using MWD.

An exemplary embodiment of the present invention includes a safety release sub-assembly that permits "unbending" or straightening of the bendable sub-assembly if, for any reason, there is a mechanical inability to straighten out the bent region of the drill tool. An exemplary embodiment provides a safety feature that permits straightening of the bendable sub-assembly through a hydraulic pressure shear release mechanism that rotates the bendable sub-assembly until it is straight. In this manner, the drill tool may be safely removed to the surface for maintenance or repairs.

In an exemplary embodiment, the drill tool assembly includes a bendable sub-assembly that has a series of electrical discharge metal ("EDM") slots in its outer surface to allow reversible deformation of the outer tube as the sub-assembly is bent to redirect the drill. Bending is caused by turning the bent nipple inside a flex nipple, the bent nipple having a central axis of rotation offset angularly from that of the flex nipple by some degrees, for example 1.5 degrees. Because of the off-center or "cammed" relationship, the flex nipple will bend at the location of the EDM slots, as the bent nipple rotates. The extent of the bending can be measured (by implication from the magnetic sensors of the J-slot) and this information can be relayed backward up the string to the startup module for transmission via pulsed hydraulics or MWD to the surface for control and management of the drilling operation.

An exemplary embodiment also provides a keyed sleeve coupling to interconnect two sections of a drill tool together when it is desirable to have the two sections rotate with respect to each other, but not separate from each other longitudinally. The coupling provides a sleeve having internal (or external) threads at one end to threadingly engage an end of a first section of the drill tool. At the other end, the sleeve has at least one internal groove that registers with a groove on the outer surface of the second section of the drill tool. Further, the sleeve has a key hole that extends through the internal groove. The external groove of the second section has a hole for engaging a pin at the tip of a metal key, which is configured to fit within the two grooves when they are in registration with each other. Thus, when the grooves are registered with each other forming an annular space between them, the key is pulled by rotation of the sleeve (or second section) into the annular space, substantially filling the space. As a result, the sleeve is keyed to the second section preventing reciprocation relative to each other, but still permitting rotation relative to each other.

BRIEF DESCRIPTION OF THE DRAWINGS

The following drawings are not to scale and are provided for ease of explanation. The figures depict exemplary embodiments and do not limit the scope of the invention.

DETAILED DESCRIPTION

The following detailed description provides a description of exemplary embodiments of the technology to facilitate an understanding of the technology, but does not limit the scope of the technology.

The term "exemplary" as applied to embodiments means "an example of."

Figure 1:
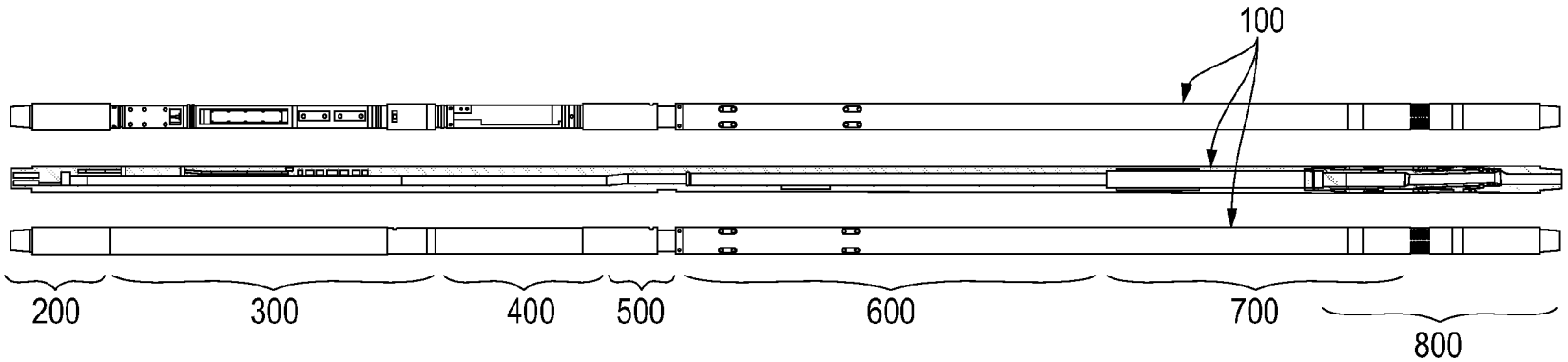
FIG. 1 is an illustration of an exemplary embodiment of a drill tool assembly according to the present invention depicting an exterior view and cross sectional views.

FIG. 1 illustrates an exemplary embodiment of a drilling tool 100 that is bendable in situ in a controlled manner on instructions from controls at the surface. Drilling tool 100 may also send feedback data to the surface and may be otherwise monitored from the surface. For ease of explanation, the tool may be regarded as having several modules, although some of these modules may be combined or separated into more component modules as a matter of design choice. In the exemplary embodiment of the present invention shown in FIG. 1, drilling tool 100 is shown with exemplary side views as well as a cross-sectional view of the entire tool. FIG. 1 further details an exemplary sequence for connecting various modules of drilling tool 100. Other sequences for connecting the various modules together are also contemplated within the scope of the present invention. In the example shown, tool 100 has, in sequence, from the upstream end: a startup and communications module 200, an electronics control module 300, a hydraulic valve assembly 400, an optional transition sub-assembly 500, a mid-assembly 600, and a lower assembly including a safety release sub-assembly 700 and a bendable sub-assembly module 800. The demarcation of FIG. 1 between these modules may not be precise because of overlap due to interconnections. Thus, the demarcations shown in FIG. 1 are approximations presented to facilitate an understanding of the technology by showing the modules in logical sequence. Each of these modules is described in more detail here below with reference to the figures.

Figure 2:
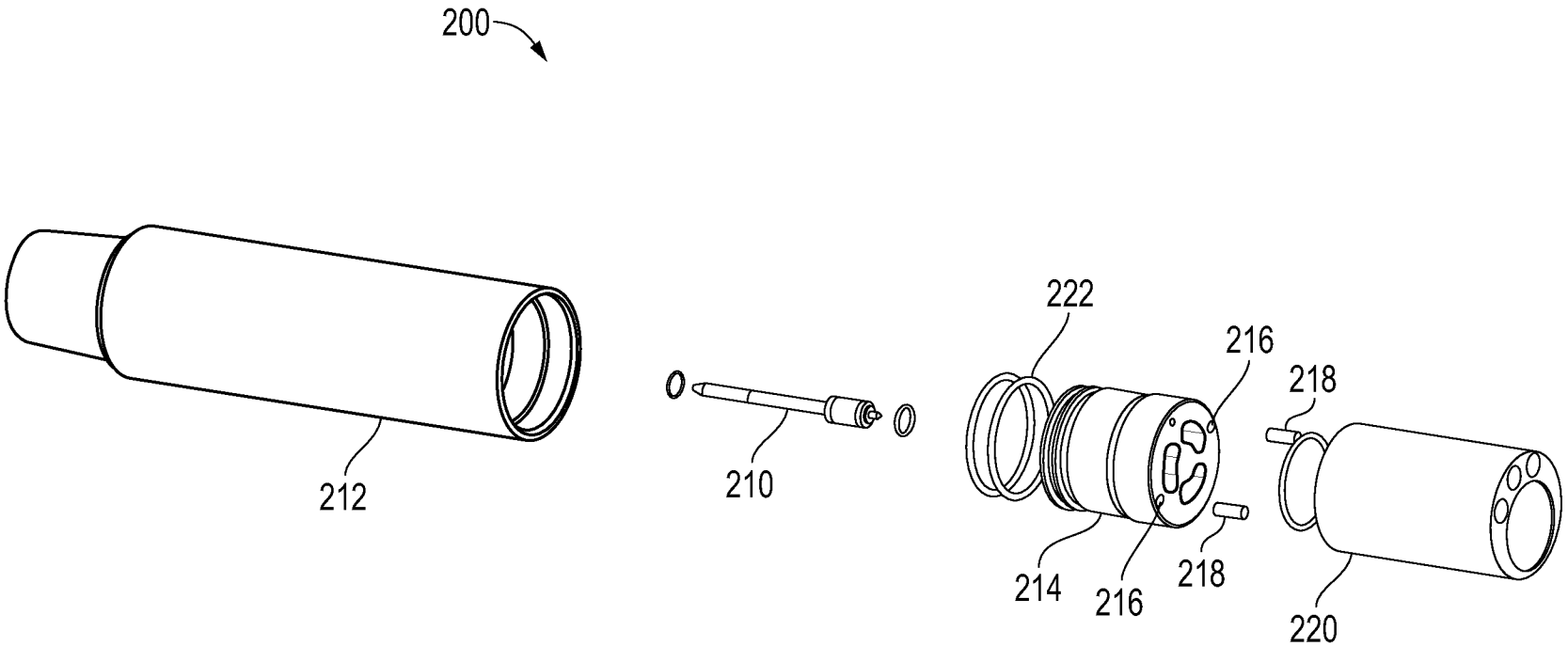
FIG. 2 is an illustration of an exemplary embodiment of a startup and communications module with an on/off fluid pressure switch that may be used in connection with the drill tool assembly of the present invention.

Next, at FIG. 2, is an exploded view illustrating a startup and communications module 200. Startup and communications module 200 is used to communicate upstream (to and from the surface controls) and to communicate downstream. That is, startup and communications module 200 receives data input from downstream modules of the tool 100 for communication upstream to the surface controls and receives data from upstream (the surface controls) to communicate as input signals to the downstream modules of the drill tool 100. In particular, in an exemplary embodiment, drill tool 100 receives command signals via pulsed hydraulic fluid where the pulsing pattern includes a coded input signal that may activate and direct the drill tool 100 so as to bend the drill tool 100 at the bendable sub-assembly 800. The startup and communications module 200 includes a probe assembly 210 that is enclosed within a housing formed by engaging a top sub 212 with a spider 214. The probe assembly 210 may then be inserted into the housing, with the housing sealed by applying a thread dope to the threads of the top sub 210 and spider 214. After applying thread dope, top sub 212 and spider 214 may be threadedly connected. The probe assembly 210 includes a pressure sensing capability to sense pressure pulses. Appropriate O-ring seals 222 and screws (not shown) may be provided for a sealed assembly. The spider 214 has a pair of bores 216 that each receive an end of a pin 218. An opposite end of pins 218 are engaged in bores of an upper transition body 220 so that the spider 214 and the upper transition body 220 are coupled together via the pins 218. The upper transition body 220 may then be used to couple the startup and communications module 200 directly with the upstream end of the following electronics control module 300.

Figure 3:
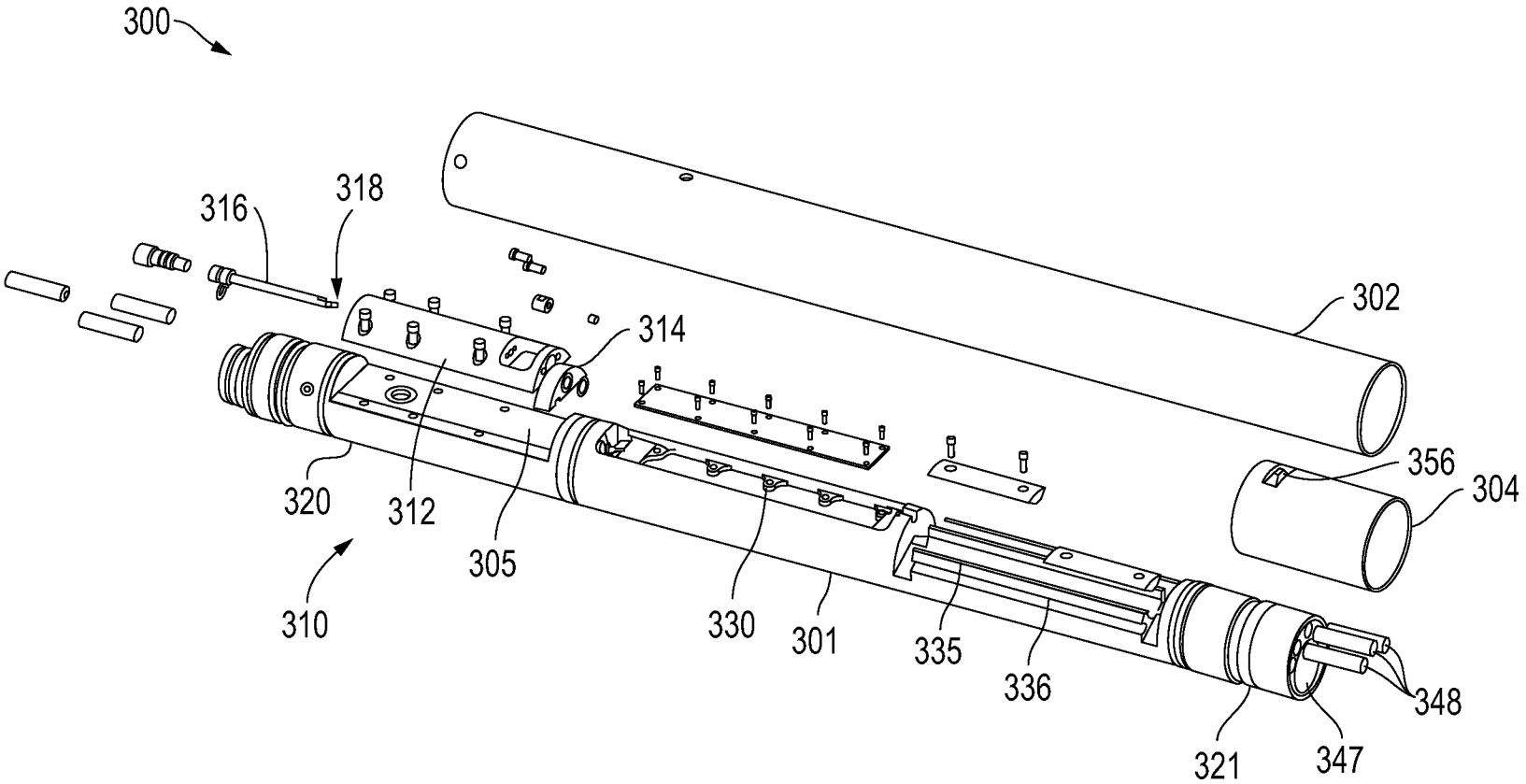
FIG. 3 is an illustration of an exemplary embodiment of an electronics control module for use in an exemplary drill tool assembly.

FIG. 3 illustrates an exploded view of an exemplary electronics control module 300. Electronics control module 300 comprises an electronics body 301 with an attached input signal receiver 310, a sensor manifold 312, a sensor piston 316 and magnetic sensor 314, an electronics sleeve 302, and a keyed joining sleeve 304. Module 300 further includes a manifold recess 305 located at an upstream end 320 for placement of sensor manifold 312. Module 300 additionally includes a power source compartment 336 for locating a power source 335 near a downstream end 321 of electronics body 301. Power source 335 may be a rechargeable battery or other type of power source. The electronics body 301 is enclosed within electronics sleeve 302. Electronics sleeve 302 may be preferably constructed from a corrosion resistant and thermally stable material to provide optimum conditions for the electronic elements contained therein. The sleeve 302 provides protection for the sensitive electronic elements contained within electronics control module 300 and helps to keep out moisture and other unwanted contaminants present in downhole well conditions. Electronics sleeve 302 may also protect the electronic components from the extreme temperatures and pressures present downhole as well as to help prevent corrosion and wear on the contained electronics, thereby extending the life of the electronic components and minimizing downtime of the drill tool 100.

At its upstream end 320, electronics control module 300 may include an input signal receiver 310 and a circuit board 330. The input signal receiver 310 includes a sensor, which may be a stationary magnetic sensor 314 that is mounted to the body of input signal receiver module 310 in manifold recess 305, and a reciprocating sensor piston 316 that has a magnetic tip 318. The stationary magnetic sensor 314 and reciprocating sensor piston 316 are preferably located within sensor manifold 312 which houses the aforementioned sensor parts and comprises a portion of input signal receiver 310. During operation, the sensor piston 316 reciprocates within the sensor manifold 312 in response to input signals received from the communications and startup module 200. Thus, the reciprocating movement of the sensor piston 316 within a bore of the sensor manifold 312 causes changes in the magnetic field generated between magnetic sensor 314 and the piston tip 318, generating a signal. When this signal conforms to a preset command signal that is programmed to activate the electronics, the electronics located on circuit board 330 are activated.

The electronics (not shown) of the circuit board 330 may include any suitable processor or CPU and sufficient memory (preferably solid state memory) that is programmable to perform the tasks required. These tasks include receiving an input command startup signal generated by the magnetic sensor 314, described above. Located further downstream on the electronics control module 300 is a power source 335. Power source 335 may be rechargeable batteries or another source of power and used to power electronics of circuit board 330. Power source 335 may also be used to supply power to the mid-assembly module 600 further downstream. At a downstream end 321, electronics control module 300 has a keyed joining sleeve 304 for connecting electronics control module 300 with the hydraulic valve assembly 400 via high pressure electrical connectors 347. Together, the electrical connectors 347 and keyed joining sleeve 304 couple electronics control module 300 with hydraulic valve assembly 400. Keyed joining sleeve 304 may also be used to couple other sections of drill tool 100 together, particularly sections that have ends requiring rotational capacity between the joining sleeve 304 to the joined end, but not to the drill tool 100 as a whole. A more detailed description of the functionality of keyed joining sleeve 304 is further disclosed in the following section.

Figure 12:
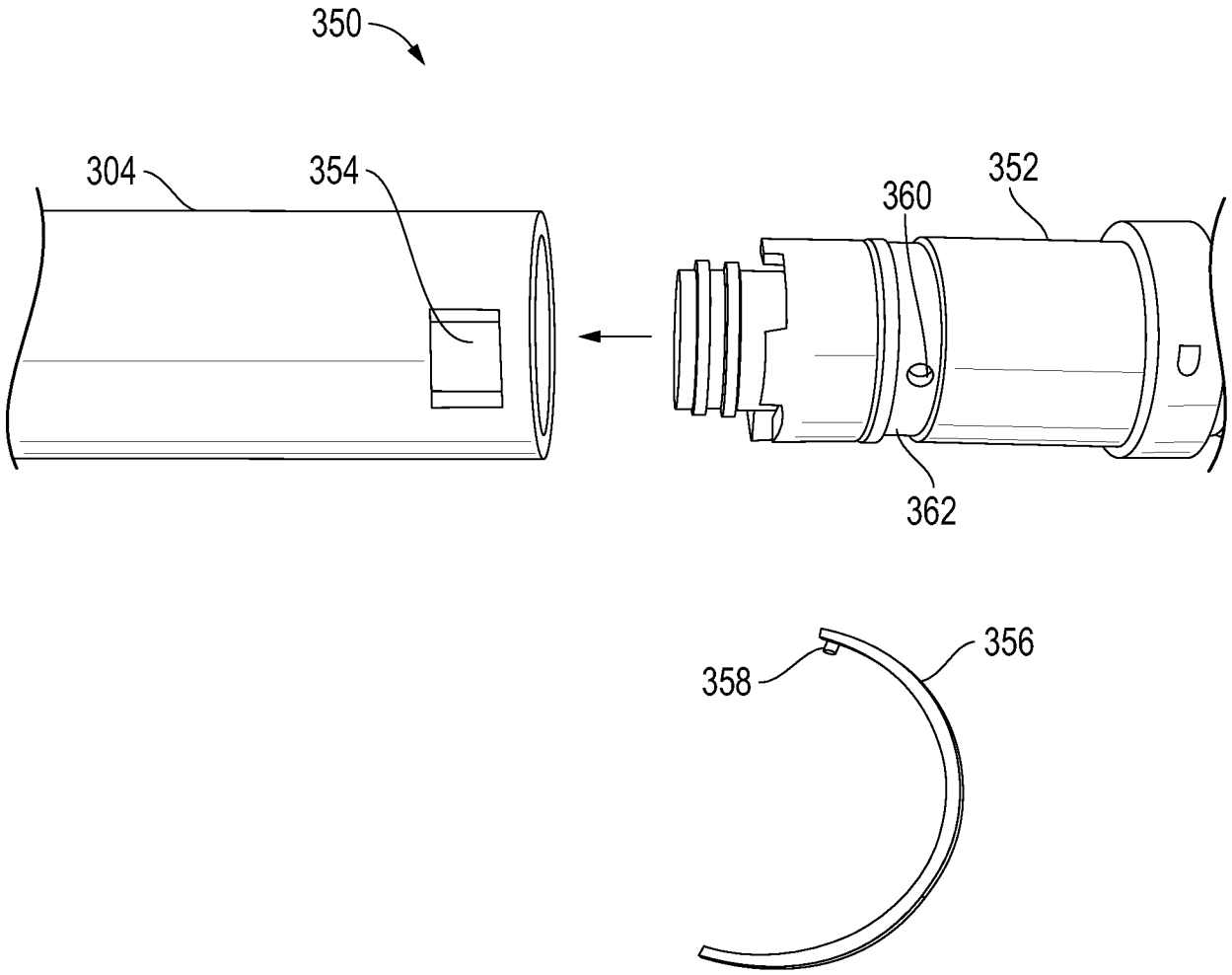
Figure 13:
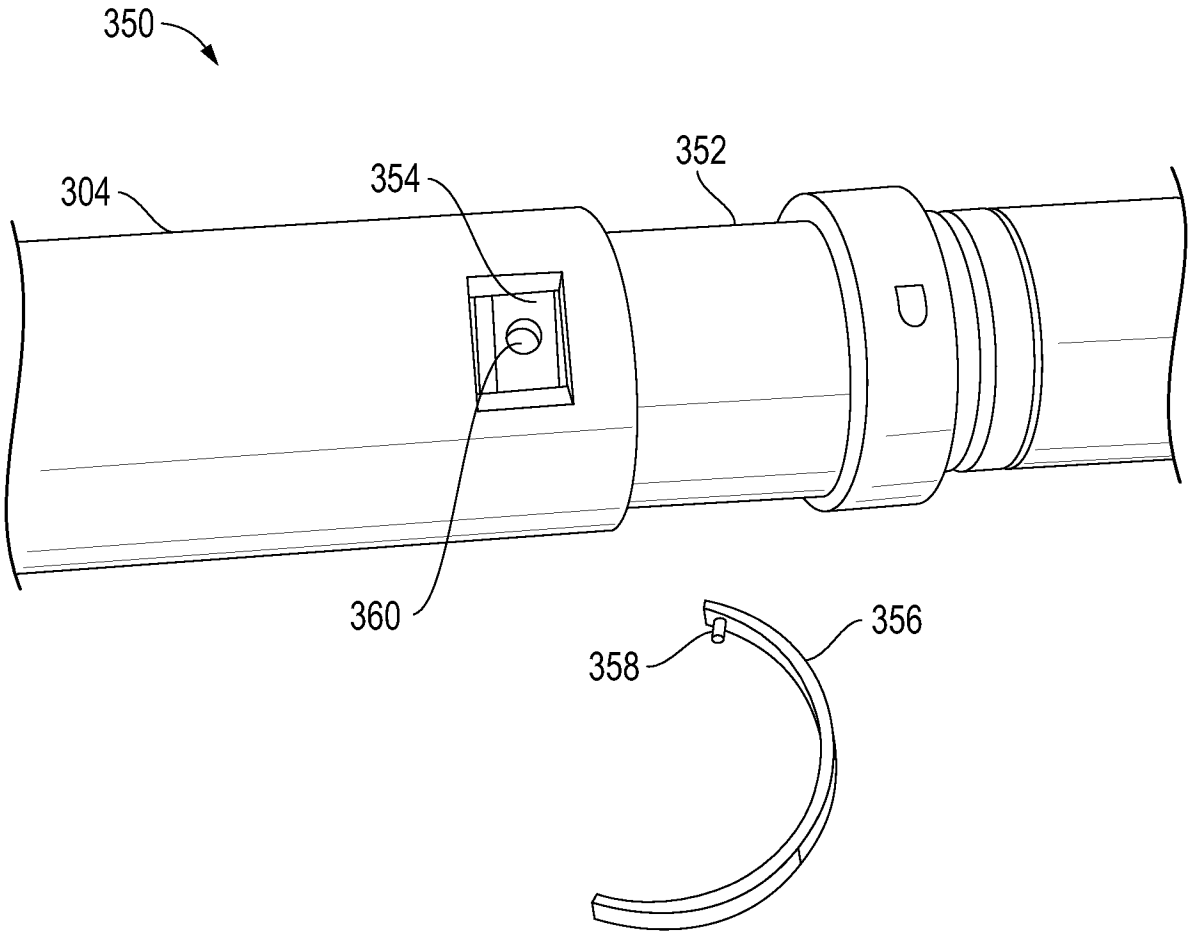
Figure 14:
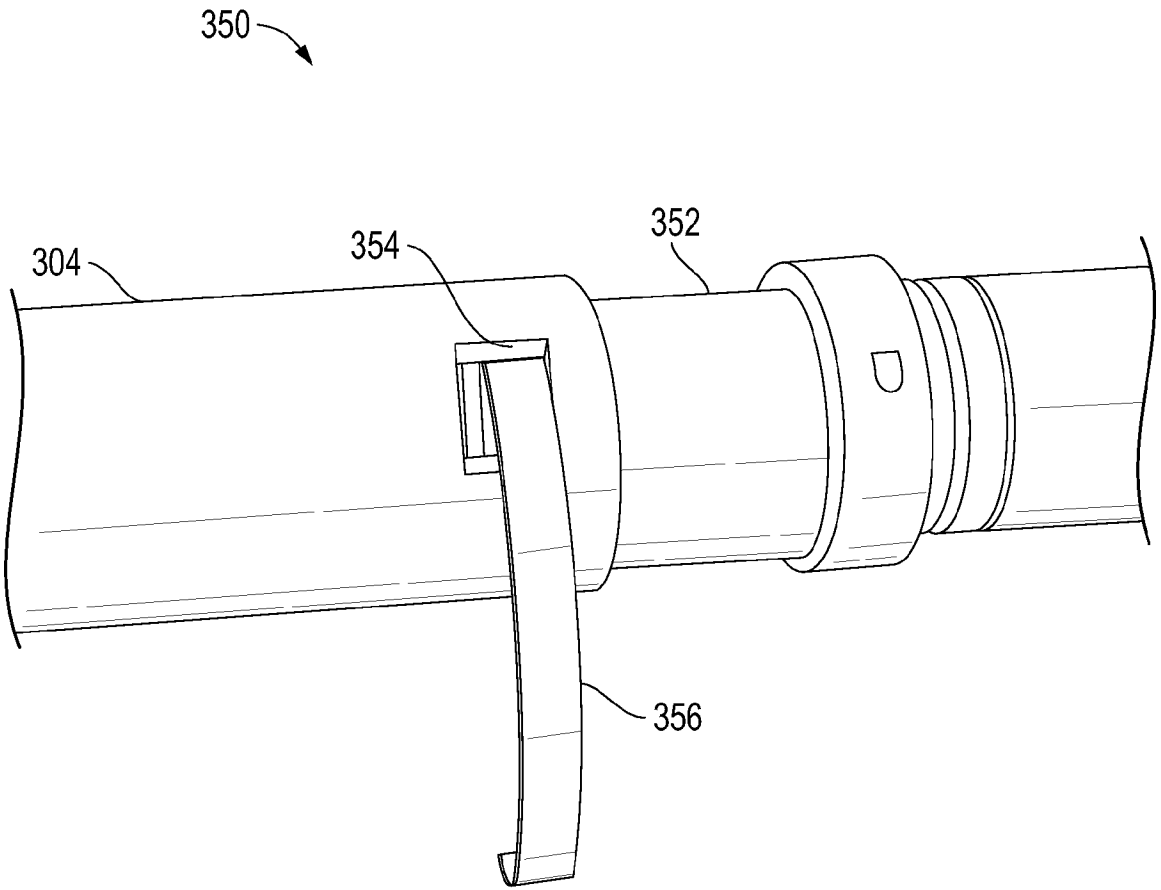

Next, turning to FIGS. 11-14, a sequence illustrating the joining of two sections of drill tool 100 using a keyed coupling 350 is shown. Keyed coupling 350 utilizes a joining sleeve, such as the joining sleeve 304 shown in FIG. 3 to be joined to a new section 352 of drill tool 100. For instance, the electronics control module 300 cannot rotate even though it is threadedly coupled to other modules of drill tool 100 because of electrical wires and pin connectors that extend through channels from downstream (and upstream) modules and to avoid binding up and failure of these wires. Therefore, the downstream end of electronics control module 300 has a keyed coupling 350 that includes joining sleeve 304 with an internal groove, not shown, and a slot 354 to receive a metal key 356, as seen more clearly in the illustrations shown in FIGS. 11, 12, 13 and 14. These figures illustrate the joining sleeve 304 and an end of the new section 352 to be coupled to the joining sleeve 304, as well as a curved metal key 356 that is configured and sized to fit within the slot 354 of sleeve 304. Further, the metal key 356 has a protruding pin 358 from one side that is sized to fit within the pin hole 360 in the groove 362 of the new section 352. Thus, when the new section 352 is slid into the sleeve 304 to a mating position, as shown in FIGS. 12-13, the internal groove (not shown) of the sleeve 304 registers with the external groove 362 of the new section 352 to form an annular space having roughly the same thickness and width of the metal key 356, and the pin hole 360 is visible through slot 354 of sleeve 304, as can be seen in FIG. 13. The pin end of metal key 356 is then inserted into the slot 354, with pin 358 engaging the pin hole 360. When the new section 352 is rotated relative to the sleeve 304 as shown in FIG. 14 with new section 352 being rotated clockwise, the key is pulled into the annular space created by the registering grooves of the sleeve 304 and the new section 352 to form a keyed lock. This lock allows the sleeve 304 to rotate relative to the new section 352, but prevents longitudinal (reciprocal) movement between the two joined components. This permits threaded engagement of tool portions and torqueing of tool portions without disruption of electrical wiring.

Figure 4:
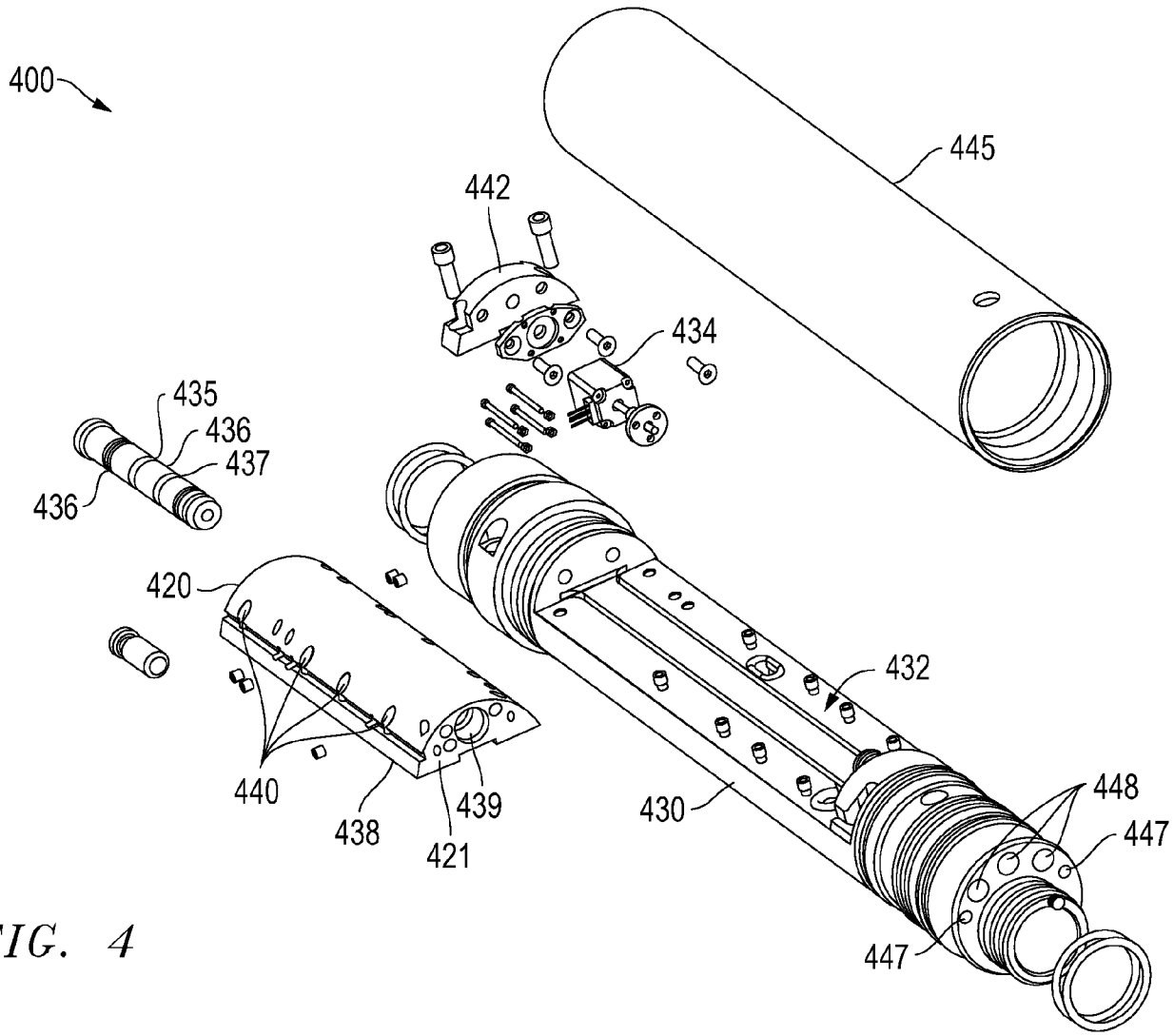
FIGS. 4, 4A, 4B, 4C and 4D illustrate an exemplary embodiment of a hydraulic valve assembly of a mid-assembly module for use in an exemplary drill tool assembly.

Referring now to FIG. 4, an exploded view of an embodiment of a hydraulic valve assembly 400 is shown. Hydraulic valve assembly 400 may include a valve housing 430, a hydraulic manifold 438, valve spool 436, motor 434, motor mount 442, and a protective sleeve 445. The valve housing may be generally cylindrical in shape and contain a recessed portion 432 for placement of the hydraulic manifold 438. The electric motor 434 may be mounted to the motor mount 442, which may then be located at an upstream end of the recess 432. The hydraulic manifold 438 may be placed in recess 432, with end 420 of hydraulic manifold 438 immediately adjacent to motor 434 and motor mount 442, and end 421 adjacent to a downstream end of the recess 432. The electric motor 434 is connected to valve spool 436 which is used to control the flow of hydraulic fluid through the hydraulic manifold 438. The motor 434 rotates a threaded shaft which positions valve spool 436 in manifold bore 439 in the upstream or downstream position to shift the J-slot. At the downstream end of valve housing 430 are a series of pin slots 448 for use in connecting and securing hydraulic valve assembly 400 to an adjacent downstream module. Next to the pin slots 448 may be electrical connections 447, which facilitate the transmission of electrical power and signals further downstream of drill tool 100.

Upon receiving a control startup signal from electronics control module 300, hydraulic valve assembly 400 activates motor 434 that motivates valve spool 436 to cause it to reciprocate in a controlled manner within the manifold bore 439 disposed centrally within hydraulic manifold 438. Valve spool 436 has a pair of circumferential grooves 435, 437 which extend in a ring-like fashion around the exterior of valve spool 436. During reciprocal motion of the valve spool 436 within bore 439 of hydraulic manifold 438, the circumferential grooves 435, 437 may align with hydraulic passages or channels 440 in the body of hydraulic manifold 438, permitting transmission of hydraulic fluid pressure. Depending on which of the grooves 435, 437 aligns with a channel 440, the hydraulic fluid may drive valve spool 436 in a first direction or an opposite direction, as explained below. The front, side, and top-down cross-sectional views of the exemplary hydraulic manifold 438 are shown in greater detail in FIGS. 4A-4D, and depict these hydraulic channels 440. In the exemplary design illustrated, hydraulic manifold 438 is seated in the middle of valve housing 430 of hydraulic valve assembly 400, and the entire hydraulic valve assembly 400 is enclosed within a surrounding protective sleeve 445 to make a compact tubular module. As with the electronics control module 300, protective sleeve 445 protects the internal components of valve assembly 400 from the hostile conditions present in a downhole environment such as extreme moisture, temperature and pressure.

Figure 4B:
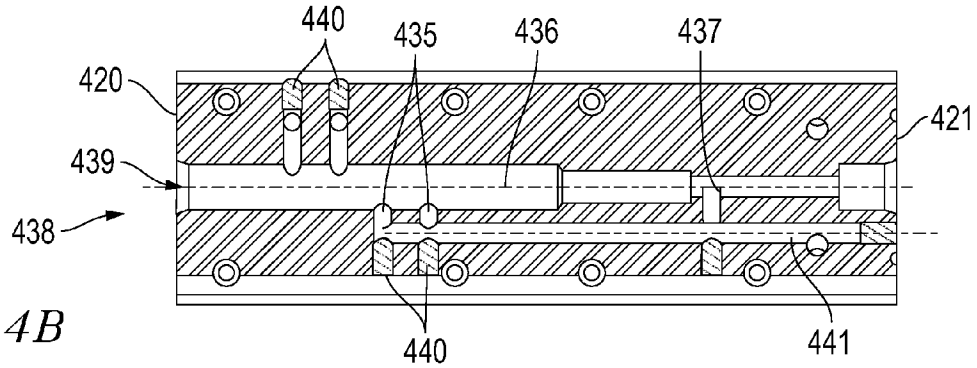
Figure 4C:
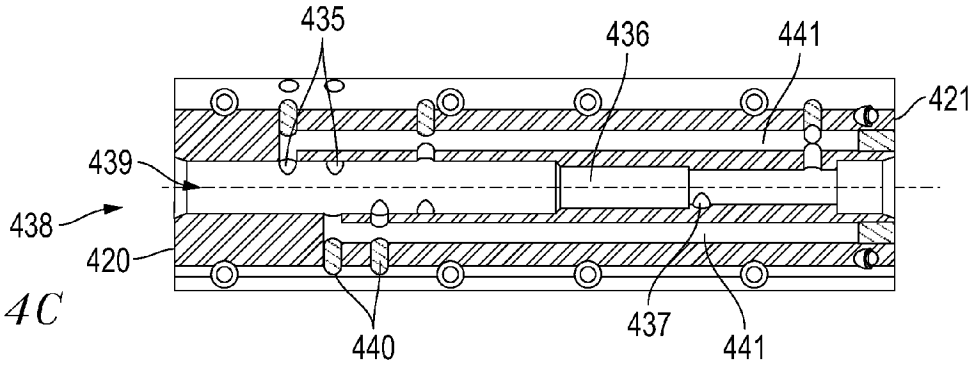
Figure 4D:
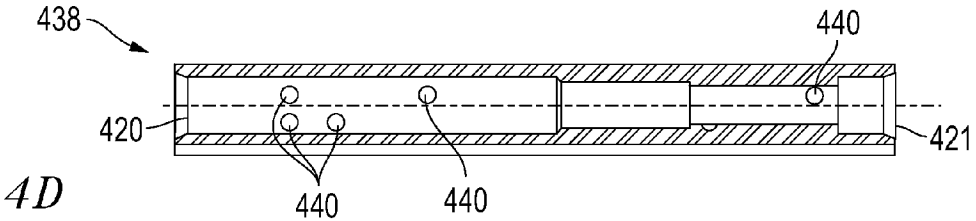
Figure 4A:
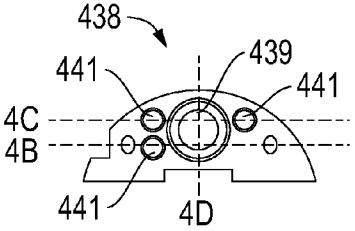

Next, at FIGS. 4A-4D, a frontal, two top-down cross-sectional, as well as a side view of the hydraulic manifold 438 are shown. In FIG. 4A, which shows a frontal view of end 421 of hydraulic manifold 438, the bore 439 within which valve spool 436 is disposed may be seen as being substantially centered in the hydraulic manifold 438. FIG. 4A further includes two bisecting horizontal lines which show the plane of view for the top-down cross-sectional views depicted in FIGS. 4B and 4C. FIG. 4A additionally includes a bisecting vertical line indicating the plane of view for the side depicted in FIG. 4D. Three openings of longitudinal channels 441 for hydraulic fluid flow may also be seen in FIG. 4A.

In FIG. 4B, a top-down cross-sectional view of the lower portion of hydraulic manifold 438 may be seen. The plane of view shown in FIG. 4B is depicted in the corresponding horizontal line of FIG. 4A. The hydraulic channels 440 are located within the body of hydraulic manifold 438 near end 420, and oriented laterally with respect to the hydraulic manifold 438. A single longitudinal channel 441 intersects a set of lateral channels 440 on one side of the bore 439 of hydraulic manifold 438. The lateral channels 440 and longitudinal channel 441 have each been plugged as shown in the figure. Additionally, valve spool 436 has been inserted into bore 439 such that the circumferential grooves 435, 437 generally align with channels 440.

Next at FIG. 4C, a top-down cross-sectional view of the upper portion of hydraulic manifold 438 may be seen. The plane of view shown in FIG. 4C is depicted in the corresponding horizontal line of FIG. 4A. Again, lateral channels 440 are located within the body of hydraulic manifold 438 near end 420 of hydraulic manifold 438. However, in the horizontal plane of view of FIG. 4C, two longitudinal channels 441 intersect the set of lateral channels 440 on either side of the bore 439 of hydraulic manifold 438. The lateral channels 440 and longitudinal channel 441 have each been plugged as shown in the figure. As shown in this figure, when the valve spool 436 is inserted into the bore 439, the grooves 435, 437 may align with lateral channels 440, which facilitate the transmission of hydraulic fluids.

Figure 6:
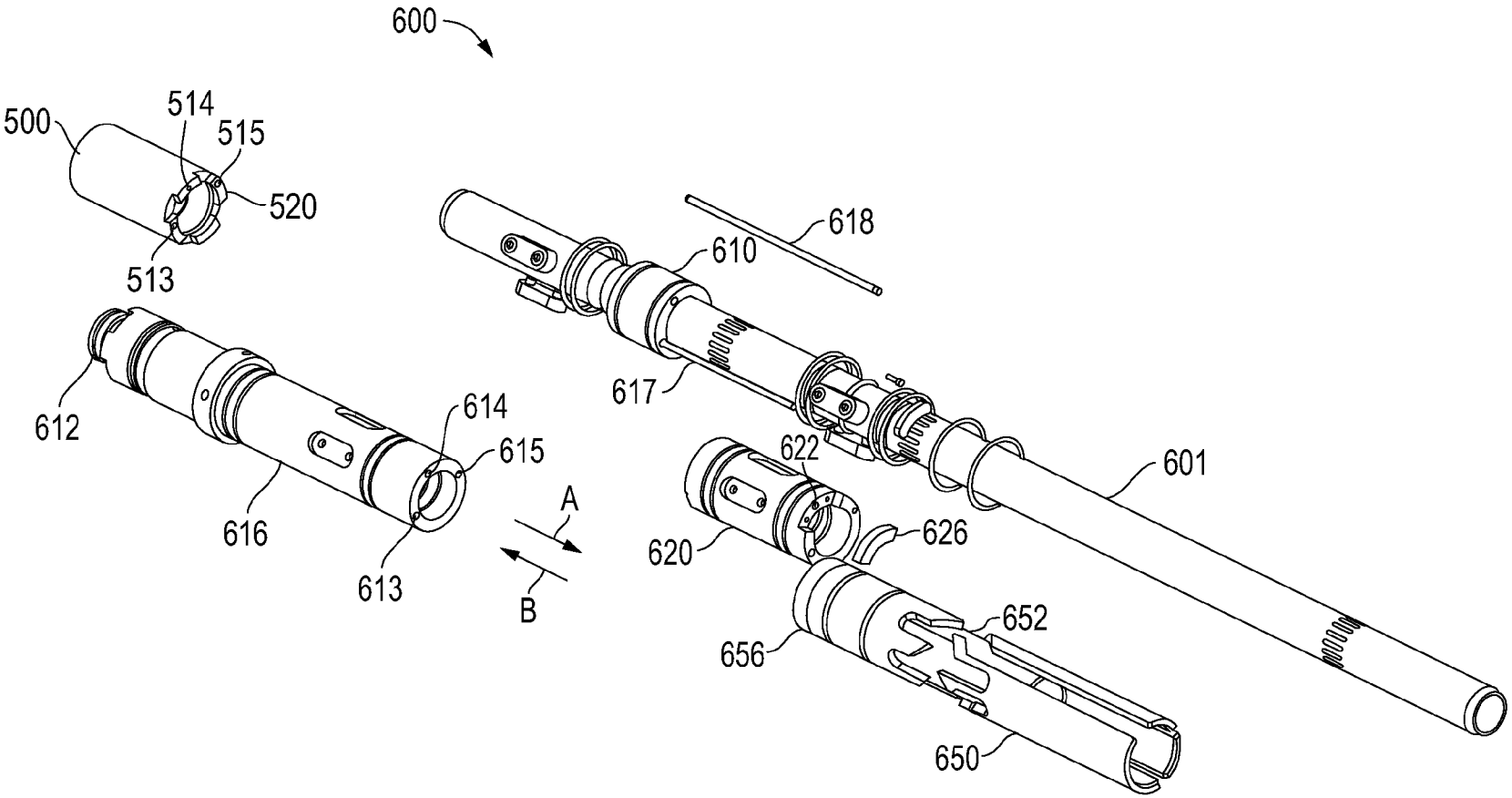
FIG. 6 is an illustration of an exemplary embodiment of a mid-assembly for use in an exemplary drill tool assembly.

At FIG. 4D, a side view of hydraulic manifold 438 is depicted. The side view of FIG. 4D provides further detail and places into context the relative locations of the lateral channels 440 as they are located along the side of hydraulic manifold 438. Thus, as can be collectively seen from FIGS. 4A-4D, bore 439 extends from an end 420 to the opposite end 421 of hydraulic manifold 438, passing through the center of hydraulic manifold 438. Hydraulic manifold 438 further contains several lateral channels 440 disposed within the body of the manifold and which extend from the central bore 439 to the exterior of the hydraulic manifold 438. Lateral channels 440 may be interconnected by one or more longitudinal channels 441 which run substantially parallel to the central bore 439 and exit at end 421 of the hydraulic manifold 438. The longitudinal channels 441 fluidically connect the lateral channels 440 with the exterior of the hydraulic manifold 438. During operation of the drill tool 100, valve spool 436 may be inserted into the bore 439 of the hydraulic manifold 438. Grooves 435, 437 on the valve spool 436 may be aligned with the channels 440 in the hydraulic manifold 438, which allows for the flow of hydraulic fluid within the channels 440, 441. Depending upon which of the grooves 435, 437 aligns with a channel 440, the hydraulics will drive the valve spool 436 in a first direction or an opposite direction. Referring briefly to FIG. 6, the hydraulic pressure provided by the hydraulic valve assembly 400 from the movement of valve spool 436 operates to drive a downstream pilot piston 610 in reciprocating fashion. The operation of pilot piston 610 is further described below.

Figure 5:
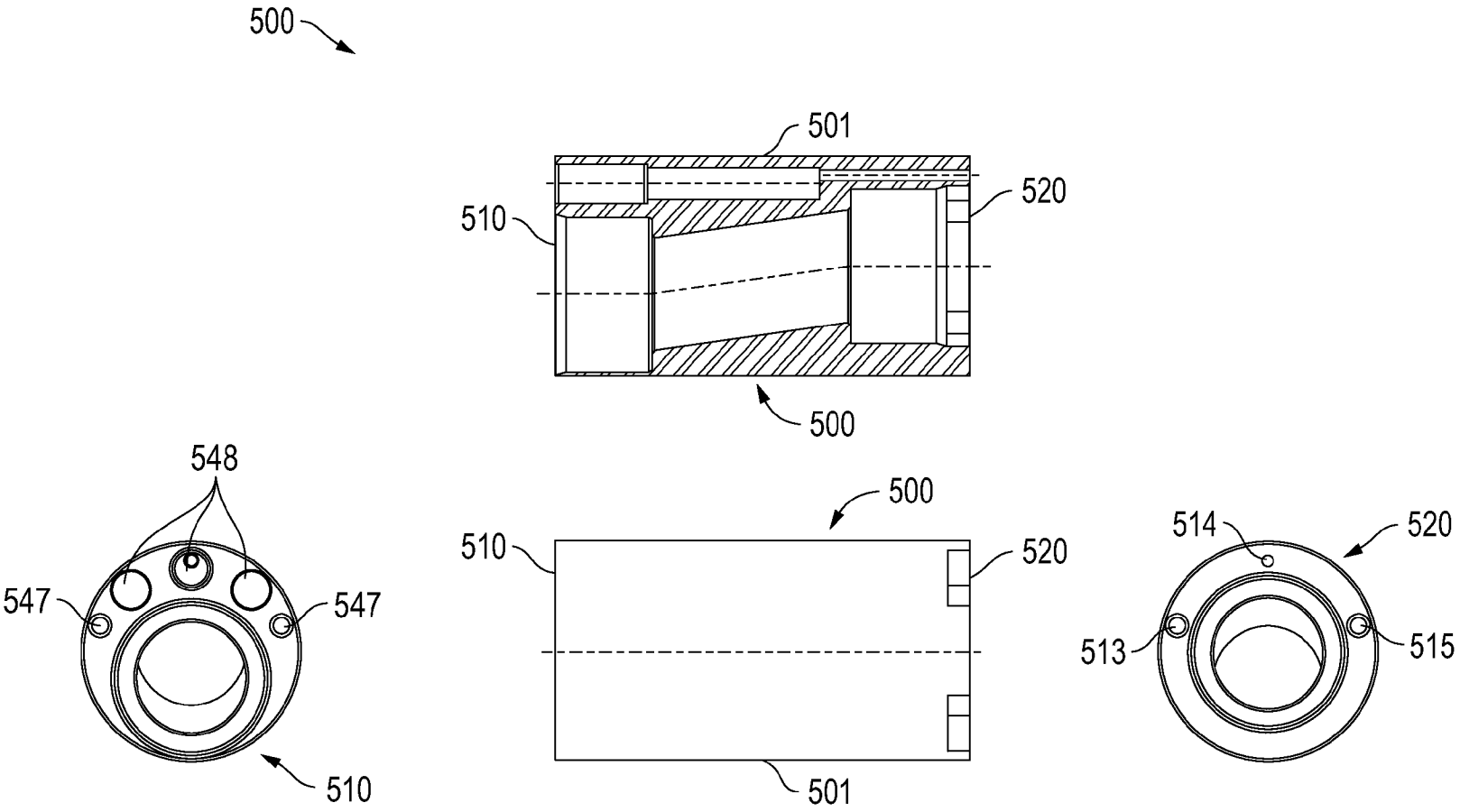
FIG. 5 is an illustration of an exemplary and optional transition sub-assembly located downstream from the hydraulic valve assembly.

Referring to FIG. 5, an optional transition sub-assembly 500 is shown. Transition sub-assembly 500 may be inserted within the sequence of modules for drill tool 100 to assist in the transition of control functions from the upstream end of the drill tool 100 to the downstream end. Transition sub-assembly 500 may comprise a cylindrical housing 501 with an upstream end 510 and a downstream end 520. Upstream end 510 may comprise appropriate connections for connecting to the downstream end of the hydraulic valve assembly 400, and may include pin slots 548 as well as electrical connections 547. Pin slots 548 may be matched up to and connected with the pin slots 448 of the hydraulic valve assembly 400 through the use of metallic pins. Electrical connections 547 may be similarly matched up and connected to the electrical connections 447 of the hydraulic valve assembly 400. Downstream end 520 may comprise appropriate connections for connecting to an upstream end 612 of a mid-assembly 600, and may include slots 513 and 515 for transmitting a hydraulic fluid further downstream from hydraulic valve assembly 400. Downstream end 520 may further include a slot 514 for carrying electrical wiring further downstream from the hydraulic valve assembly 400.

Similar to the electronics control module 300, the transition sub-assembly 500 cannot rotate as it is coupled to other modules of the drill tool 100 through the use of pins located in recesses in the outer circumference of the cylindrical housing 501 of the transition sub-assembly 500 because of electrical wires that extend through channels from downstream (and upstream) modules and to avoid binding up and failure of these wires. The use of transition sub-assembly 500 allows for wires and other critical electronic components to have more "give" in transitioning between the upstream and downstream ends of drill tool 100, as it provides for flexible movement between its upstream end 510 and downstream end 520. Transition sub-assembly 500 further transitions the connections on the downstream end of hydraulic valve assembly 400 to the connections on the upstream end of the mid-assembly 600. As can be seen from FIGS. 3, 4 and 4A, the hydraulic components may be mounted within a single tubular housing. This is a compact arrangement, and it might be advantageous to expand and center the hydraulics within the drill tool downstream from the electronics control module 300.

Next, FIG. 6 illustrates an embodiment of a mid-assembly 600 located further downstream from the hydraulic valve assembly 400 and transition sub-assembly 500, and comprises a pilot piston assembly 601 with an attached pilot piston 610. Mid-assembly 600 may be further comprised of an extension sub 616, a sensor sleeve 620, and a J-slot assembly 650 that are fitted around the pilot piston assembly 601. This can be seen in FIG. 6 wherein the pilot piston assembly 601 has the extension sub 616, sensor sleeve 620, and J-slot assembly 650 off to the side to show how they may be fitted onto and around the pilot piston assembly 601. Thus, the extension sub may be fitted to pilot piston 610 immediately adjacent to the upstream end of pilot piston 610. Sensor sleeve 620 may be fitted onto pilot piston assembly 601 downstream of pilot piston 610. The J-slot assembly 650 may be fitted to pilot piston assembly 601 immediately downstream of sensor sleeve 620. Depending on the position of valve spool 436, hydraulic pressure is admitted to one or the other side of the pilot piston 610, causing the J-slot to advance toward the next angular setting.

On the upstream end of mid-assembly 600, end 520 of the exemplary lower transition sub-assembly 500 from FIG. 5 is shown and has three through bores: a central (electrical) bore 514 for carrying therethrough electrical wires and a pair of opposite hydraulic bores 513, 515 for transmission of hydraulic fluid. Downstream end 520 of transition sub-assembly 500 may be mechanically coupled in a non-rotating manner to an extension sub 616 of mid-assembly 600 that has a corresponding extension for bores 513, 514, 515 of transition sub-assembly 500, wherein the exit ports of these bores are similarly numbered as 613, 614, and 615 for ease of explanation. That is, bores 513, 514, and 515 of the transition sub-assembly 500 align with and match up to bores 613, 614, and 615 of extension sub 616, further transmitting respective electrical signals and hydraulic fluid downstream of the mid-assembly 600.

Hydraulic fluid pressure provided from the hydraulic valve assembly 400 is transmitted via bores 515 and 615 into tube 618 (shown as disengaged from pilot piston assembly 601) to urge the pilot piston 610 in the downstream (forward) direction of arrow A, whereas hydraulic pressure in port 613 urges the pilot piston 610 in an upstream (backward) direction, shown by arrow B. Hydraulic fluid for reversing pilot piston 610 flows from port 613 into tube 617 to sensor sleeve 620 to reverse piston movement. Each forward and backward motion of the pilot piston 610 constitutes a cycle, and each single forward or backward motion causes J-slot assembly 650 to rotate by one increment. The incremental rotation of the J-slot assembly 650 causes the bendable sub-assembly 800 to bend in a direction by 1 to 3 degrees. It is the unique slotted design pattern of the J-slot assembly that determines the exact degree of bending of the bendable sub-assembly, the details of which will be further described below.

Figure 7:
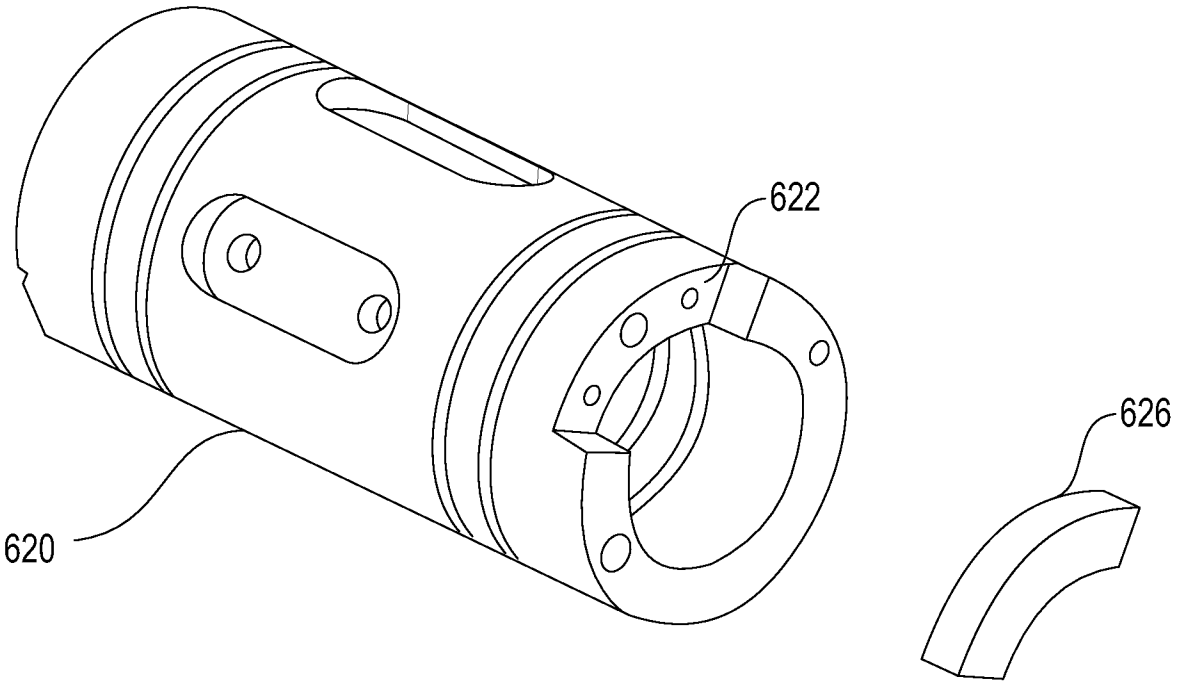
FIG. 7 is an illustration of an exemplary embodiment of a sensor sleeve that may be used with a mid-assembly of an exemplary drill tool assembly.

Now turning to FIG. 7, a preferred embodiment of sensor sleeve 620 is shown in greater detail. As can be more clearly seen in FIG. 7, sensor sleeve 620 has a notch 622 extending along a portion of its perimeter that is sized and configured to receive a magnetic sensing element 626, such as a hall-effect sensor, that is mounted to the sensing sleeve 620. Referring back to FIG. 6, sensing sleeve 620 abuts against an upstream end of the J-slot assembly 650 that includes a magnetic ring assembly 656. The magnet sensing element 626 may be oriented relative to the J-slot assembly 650, for example, such that the magnetic sensing element 626 is in its uppermost position when the J-slot assembly 656 is rotated such that its slot 652 is in its uppermost position. Thus, a correspondence between magnetic sensing element 626 and slot 652 may be established for detection and control purposes. When assembled together, the magnetic sensing element 626 is adjacent the magnetic ring assembly 656 and the interaction of the magnetic fields between the magnetic sensing element 626 and magnetic ring assembly 656 provides a ready means to measure (and control) the orientation (i.e. rotational displacement) of the J-slot assembly 650 during operations. Thus, depending on the particular orientation of magnetic ring assembly 656 relative to the magnetic sensing element 626, the particular current positioning of the J-slot 652 may be determined and appropriate control signals may be inputted for further movement of the J-slot assembly 650.

Figure 8:
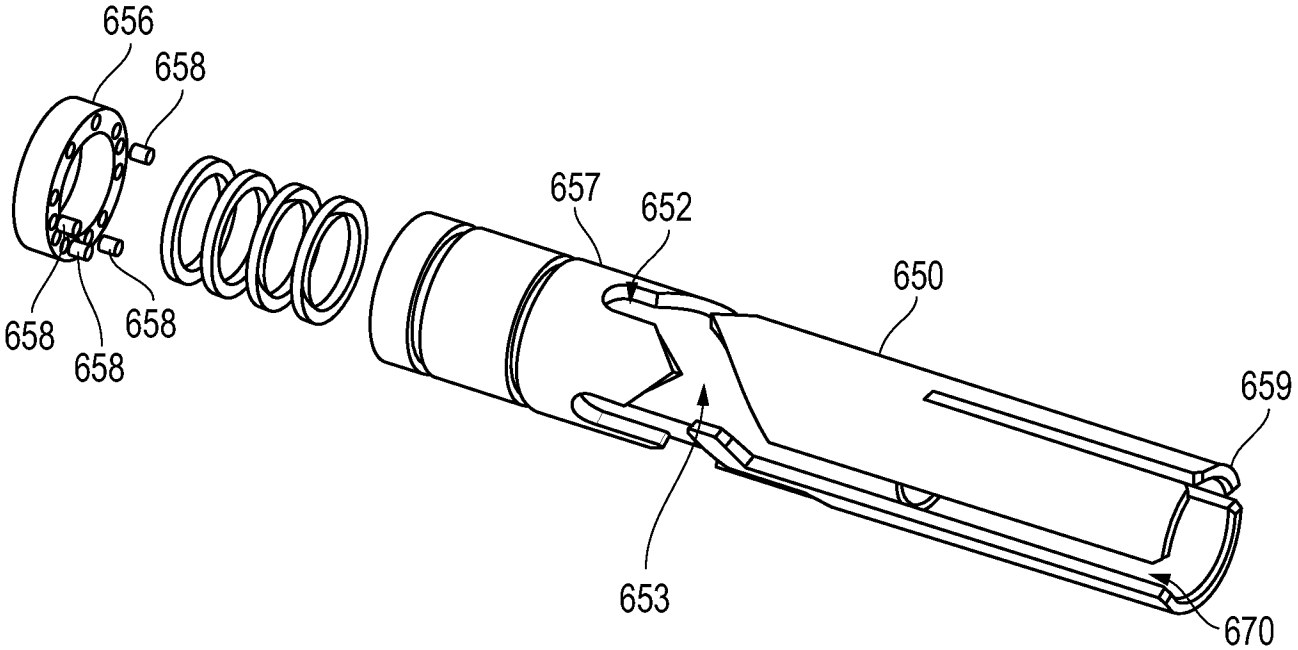
FIGS. 8 and 8A are illustrations of an exemplary embodiment of a J-slot and magnet assembly of a mid-assembly module of an exemplary drill tool assembly.

FIG. 8 illustrates an isometric view of the magnetic assembly ring 656 and accompanying magnets 658, as well as a preferred embodiment of the J-slot assembly 650. In particular, FIG. 8 presents the location of the circular array of four magnets 658 in slots of the magnetic assembly ring 656. The magnets 658 may preferably be cylindrical in shape so as to be more readily fitted into the slots of the magnetic assembly ring 656. Magnets 658 may also be preferably oriented in the same magnetic direction such that like magnetic poles face the same direction when installed into the slots of magnetic assembly ring 656. By utilizing the array of magnets 658 and the magnetic sensing element 626, the orientation of the J-slot 652 of the J-slot assembly 650 may be determined. Information regarding the positioning of the overall J-slot assembly 650 relative to the mid-assembly 600 derived from the magnetic field generated by magnets 658 may be transmitted via the electronics control module 300 and the startup and communications module 200 to a control interface located at the surface. At the surface, operators of drill tool 100 may utilize the communicated information regarding the orientation and position of the J-slot assembly 650 to determine further angular movements to the J-slot assembly 650 during the drilling process.

Remaining on FIG. 8, J-slot assembly 650 may generally be a cylindrical section with a series of interconnected J-slots 652 oriented longitudinally along the outside of the cylinder. The slots may terminate into a semicircular contour along an upstream side 657 and a downstream side 659 of the J-slot assembly 650 for preferred guiding of a pin 660 that extends from the pilot piston assembly 601. The longitudinal slots 652 may be separated by several predetermined distances laterally along the circumference of the J-slot assembly 650, with each unique distance corresponding to a different angular degree of bending in the bendable sub-assembly 800 located further downstream on drill tool 100. The longitudinal J-slots 652 may preferably be interconnected by substantially 45 degree slots 653 in an alternating zig-zag fashion. The zig-zag orientation of the longitudinal slots 652 and 45 degree slots 653 may further include and terminate into a substantially elongated slot 670 which extends all the way to the downstream side 659 of the J-slot assembly 650.

Figure 8A:
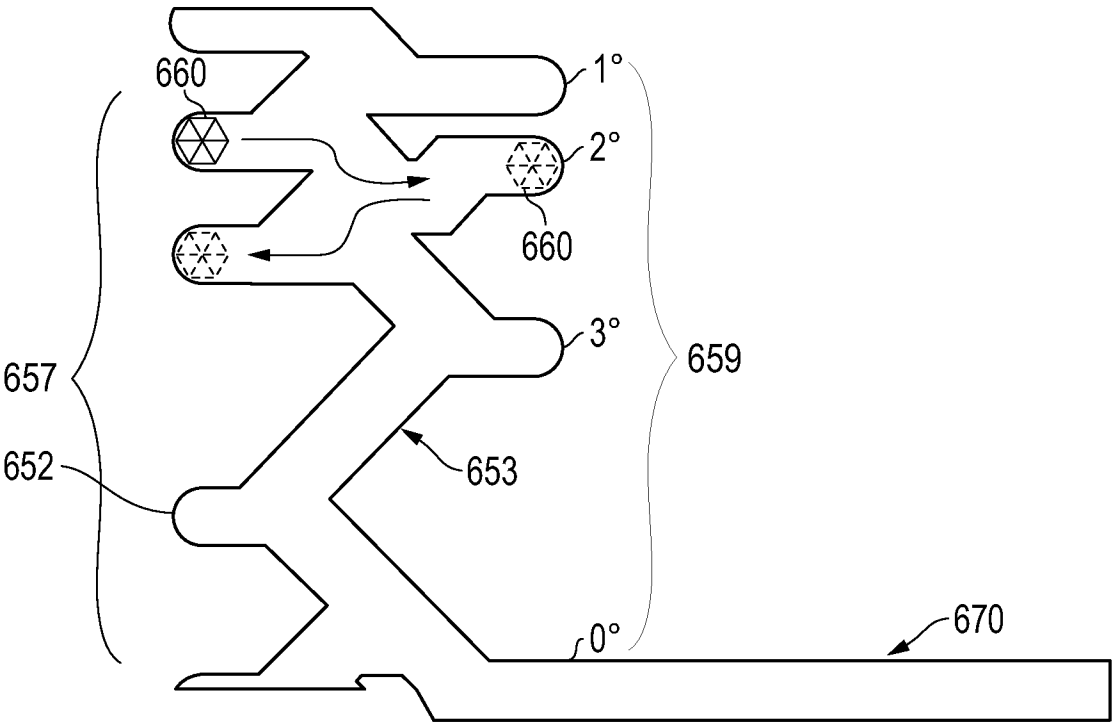

Next, FIG. 8A illustrates a 2-dimensional map of the exemplary circumferential J-slot assembly 650 showing the contours of its surface, and reveals the longitudinal slots 652 and interconnecting slots 653 of the J-slot assembly 650 in greater detail. The surface contours of the slots 652 and 653 interact with the pin 660 that extends from pilot piston assembly 601 into the slot and guides movement of the J-slot assembly 650 as the pilot piston 610 reciprocates. During operation of the drill tool 100, the J-slot assembly 650 rotates about the pilot piston assembly 601 in conjunction with the reciprocating action of the pilot piston 610. As the J-slot assembly 650 rotates, the contoured slots guide the pin 660 between the upstream side of the J-slot 657 and the downstream side 659. During movement of pin 660 between the upstream side 657 and downstream side 659, pin 660 will naturally engage the substantially 45 degree slots 653 connecting individual longitudinal J-slots 652. This engagement of the substantially 45 degree slots 653 forces the J-slot assembly 650 to rotate in set increments in one direction. The incremental rotation of the J-slot assembly 650 facilitates the angular movement of the bendable sub-assembly 800. In particular, the individual slots located on the downstream side 659 of J-slot assembly 650 correspond to specific angles for bendable sub-assembly 800. Depending on the particular downstream side J-slot 652 that pin 660 may currently reside in, bendable sub-assembly 800 will be bent in varying increments of 1 to 3 degrees from normal, as indicated in FIG. 8A. In this manner, a controlled bending of drill tool 100, particularly at the drill head, may be accomplished, thereby allowing operators at the surface to continuously control the drill direction of drill tool 100 in real-time.

Figure 9:
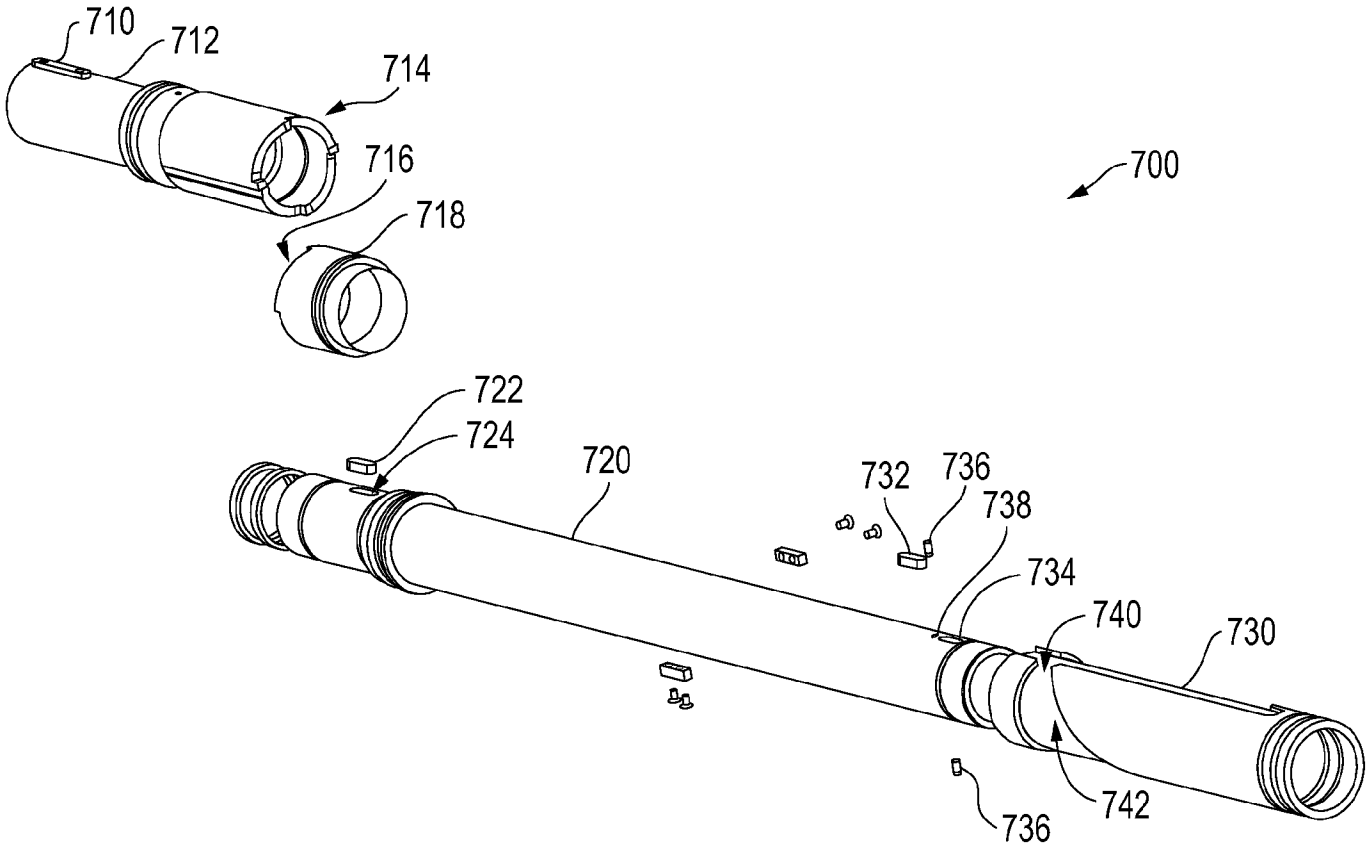
FIGS. 9 and 9A are illustrations of an exemplary embodiment of a safety release sub-assembly, including an exemplary release sleeve and a locus of its path, for use in an exemplary drill tool assembly.
Figure 9A:
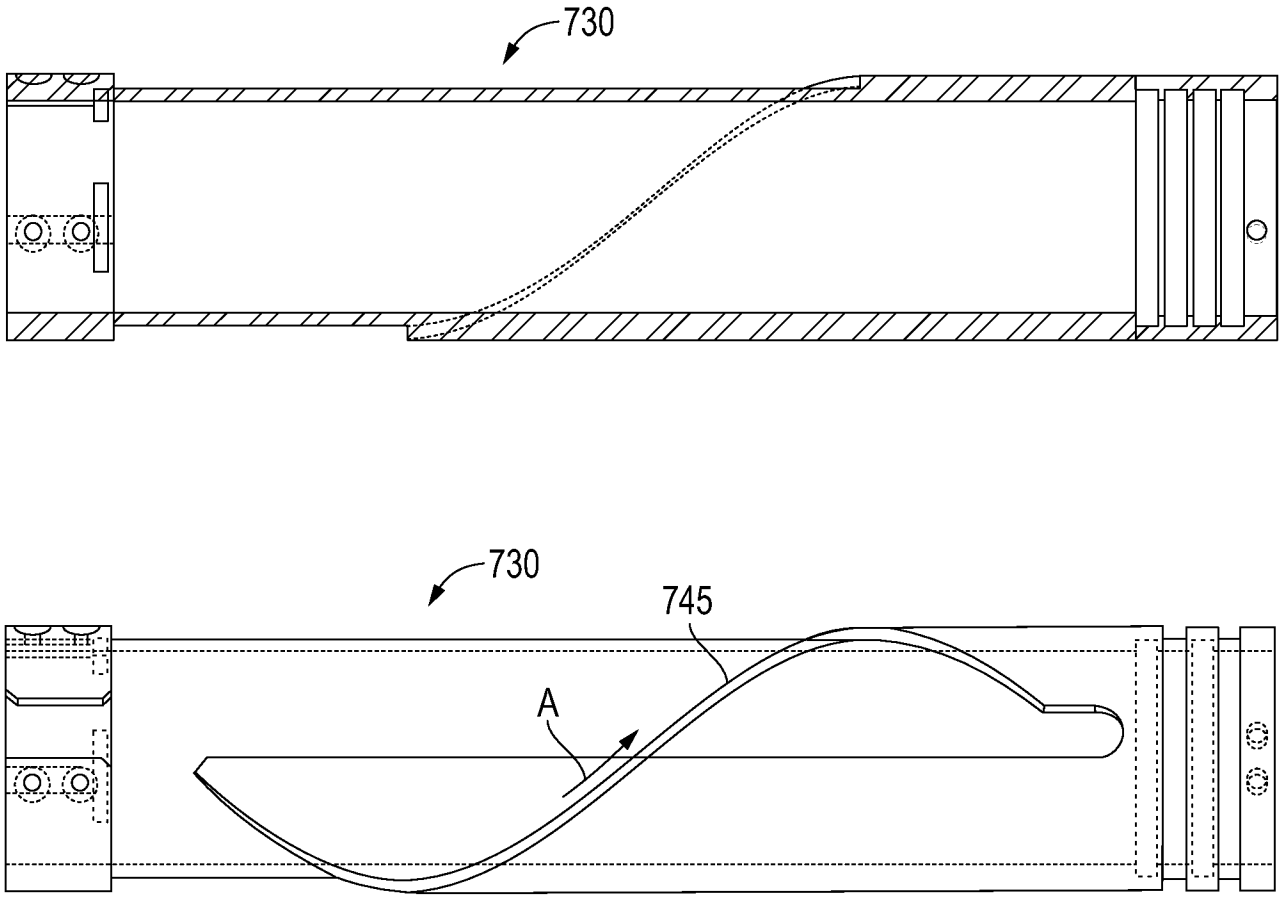

Referring now to FIGS. 9 and 9A, therein is shown a safety release sub-assembly 700, which includes a clutch weldment 712, ratchet 718, torque tube 720, and release sleeve 730. In an exemplary embodiment of the invention, safety release sub-assembly 700 may be used to "unbend" or straighten out the bendable sub-assembly 800. Generally, bendable sub-assembly 800 may be bent in a direction at an angle between 1 to 3 degrees by incremental rotation of the J-slot assembly 650. Bendable sub-assembly 800 may also be able to return to an original, unbent position if desired. However, circumstances may arise wherein bendable sub-assembly 800 is unable to return to the unbent original state. If, for any reason, there is a mechanical inability to straighten out the bent region of the drill tool through rotation of the J-slot assembly 650, it may become difficult or impossible to remove drill tool 100 from the downhole bore. Under these circumstances, safety release sub-assembly 700 provides a safety feature that permits straightening of the bendable sub-assembly 800 through a hydraulic pressure shear release mechanism that rotates the bendable sub-assembly 800 until it is straight. In this manner, the drill tool 100 may be safely removed to the surface for maintenance or repairs.

At the upstream end of safety release sub-assembly 700, clutch weldment 712 may be engaged to the downstream end of the J-slot assembly 650. In particular, clutch weldment 712 may be engaged to elongated slot 670 through the use of a key 710 which extends from the body of clutch weldment 712 and catches the edges of elongated slot 670. During rotation of the J-slot assembly 650 induced by the pilot piston 610, slot 670 may engage key 710 to forcibly turn the clutch weldment 712 in the same rotational direction as the J-slot assembly 650. This causes rotational locking of the J-slot assembly 650 to the safety release sub-assembly 700. The clutch weldment 712 is connected at a downstream end to the ratchet 718 through the use of a clutch formed between a downstream clutch 714 of clutch weldment 712 and an upstream clutch 716 of the ratchet 718. Thus, reciprocating the clutch weldment 712 relative to the ratchet 718 can be used to engage or disengage the clutches 714 and 716. The ratchet 718 may be coupled to the torque tube 720 through the use of a key 722 that is inserted into a slot 724 within the body of torque tube 720. To facilitate the coupling, ratchet 718 is slidingly engaged to an upstream end of torque tube 720, and key 722 is inserted into slot 724, causing ratchet 718 and torque tube 720 to be rotationally locked together.

The cylindrical torque tube 720 may be key-coupled to the release sleeve 730 in similar fashion to the connection between ratchet 718 and torque tube 720. That is, release sleeve 730 may be slidingly engaged to a downstream end of torque tube 720. A key 732 similar to key 722 may then be inserted into a slot 734, thereby rotationally locking torque tube 720 and release sleeve 730 together. Thus, when keys 722 and 732 are engaged to lock ratchet 718, torque tube 720 and release sleeve 730 together, the entire safety release sub-assembly 700 may be rotated together as a single unit when the clutches 714 and 716 are engaged.

A pair of shear pins 736 are each fitted into holes 738 (only one shown). A guide pin, not shown, extends to position 740 indicated on the slot-pattern 742 of the release sleeve 730 such that when sleeve 730 rotates during normal operation, the guide pin of position 740 does not engage with the slot-pattern 742. However, if it is desirable or necessary to straighten bendable sub-assembly 800 in order to pull it back upstream or to the surface, and it cannot straighten, then the clutch weldment 712 is disengaged from the ratchet 718, and hydraulic pressure is used to shear the shear pins 736 and rotate the release sleeve 730, with the guide pin now engaged in the slot-pattern 742 of the release sleeve 730. This controlled rotation straightens the bendable sub-assembly 800 thereby permitting it to be drawn up into the casing to the surface.

Turning to FIG. 9A, a locus of a path 745 is shown that the guide pin (at location 740) will travel as the release sleeve 730 rotates to straighten and free the bendable sub-assembly 800. The guide pin essentially follows the curvature shown in path 745 in the direction indicated by the arrow A.

Figure 10:
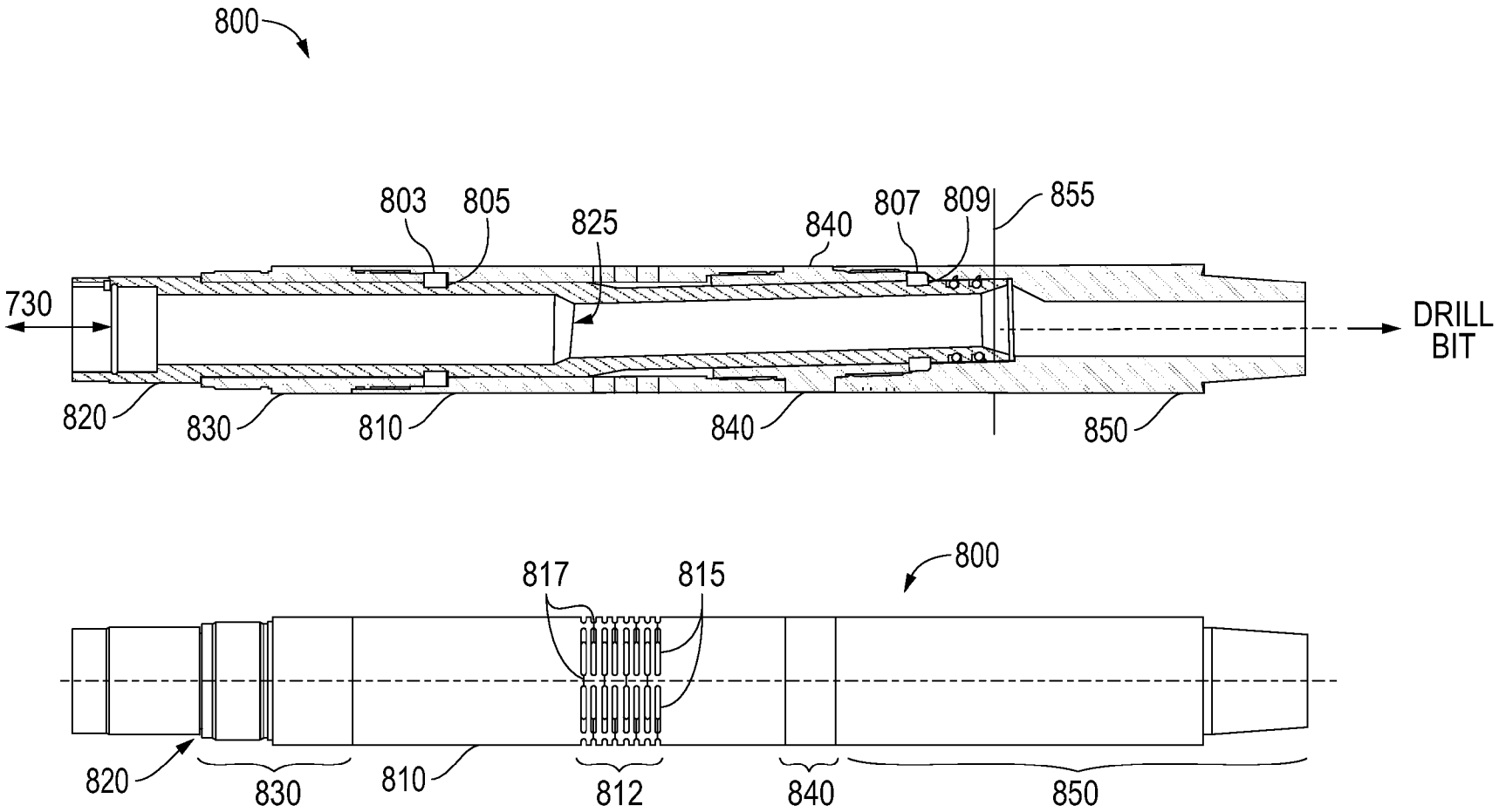
FIG. 10 is an illustration of an exemplary embodiment of a bendable sub-assembly for use in an exemplary drill tool assembly.
Figure 11:
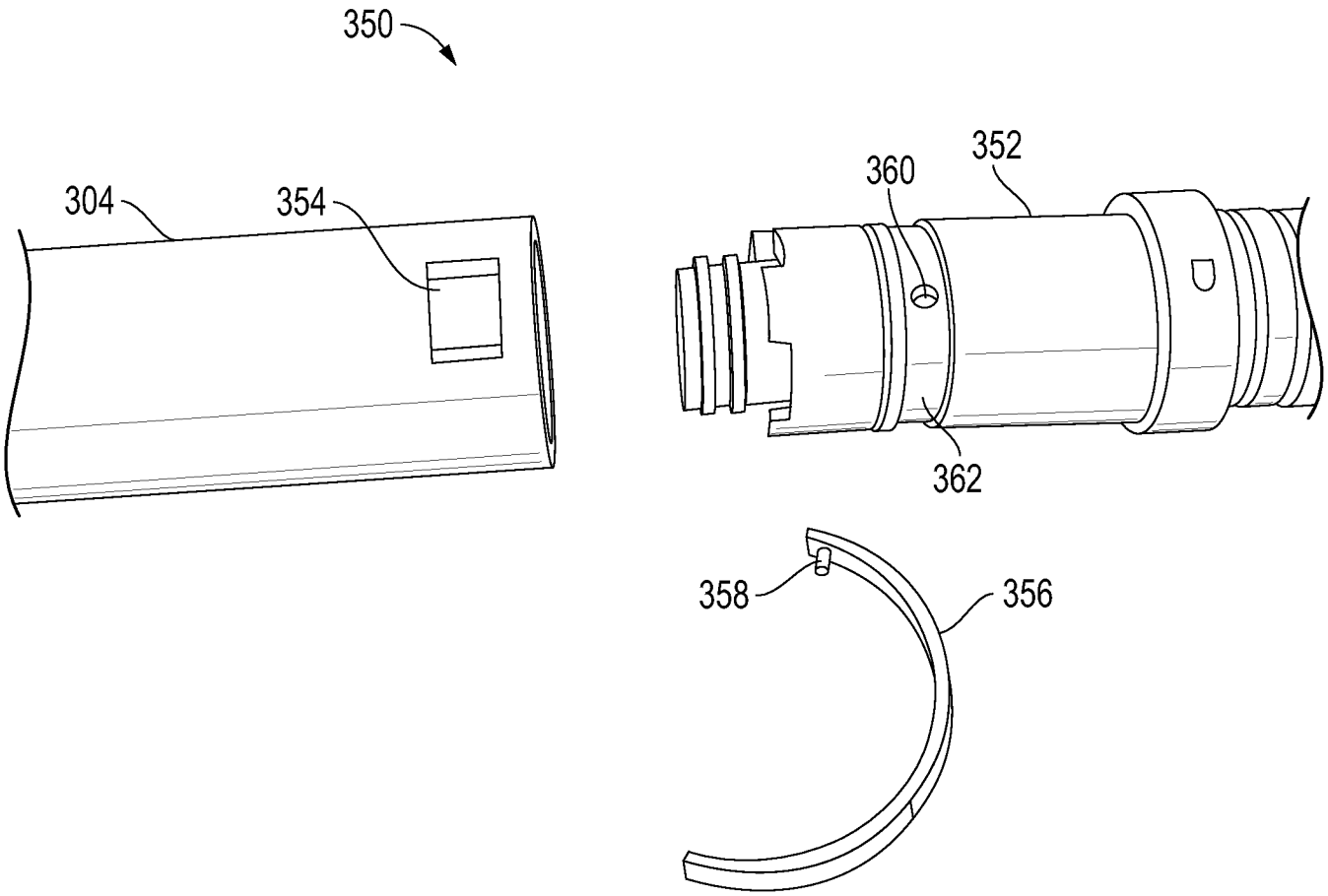
FIGS. 11-14 is a sequence illustrating the joining of two sections of an embodiment of the drill tool using a keyed coupling when it is desirable to have the two sections rotate with respect to each other, but remain operatively connected in the longitudinal direction.

In FIG. 10, therein is depicted a cross-sectional view and a side view of an exemplary embodiment of the bendable sub-assembly 800. Bendable sub-assembly 800 may be comprised of at least a flex nipple 810, bent nipple 820, an adapter sleeve 830, a flex nipple sub-assembly 840, and a bottom sub-assembly 850. As shown in FIG. 10, a downstream end of the release sleeve 730 is coupled to an upstream end of bendable sub-assembly 800. The bendable sub-assembly 800 includes a bent nipple 820 that is coupled to the safety release sleeve 730. The bent nipple is bent at an angle at 825. As a result, the axis of rotation of the bent portion of bent nipple 820, downstream from position 825, is off center from the longitudinal axis of the (straight portion upstream of point 825) bent nipple 820. In the example shown, the offset in degrees, $\alpha$, is 1.5 degrees. Thus, rotation of the sub-assembly 800 and the bent nipple 820 through about 90 degrees will bend the portion of bent nipple downstream from point 825, and thus the bendable sub-assembly 800. This results in a bending at the region indicated at 812 by 1.5 degrees or 2 degrees depending on the configuration of the J-slot assembly 650; a rotation of the bent nipple 820 by about 180 degrees will bend the region 812 by 3 degrees. Other offsets of a degrees may also be used as convenient and necessary.

Remaining on FIG. 10, it can be seen that bent nipple 820 is nested within a series of surrounding layers. In the vicinity of the upstream end, bent nipple 820 is surrounded by the adapter sleeve 830. Downstream of the adapter sleeve 830, and extending through the region 812 where bending takes place, the bent nipple 820 is surrounded by a flex nipple 810. The adapter sleeve 830 and flex nipple 810 are connected together to form a groove 805, with a ring 803 positioned in and registering with the groove 805. The flex nipple 810 may comprise a region 812 with a series of laterally oriented elongated cavities 815. Selected elongated cavities 815 may be interconnected with one another via a narrow channel 817 which helps facilitate bending of region 812. Channels 817 may be non-uniformly distributed to interconnect various selected cavities 815 such that the overall structural integrity of the bent nipple 820 is maintained. That is, channels 817 may be distributed so that the flex nipple 810 is one contiguous piece of material that is structurally sound but provides for the flex nipple 810 to bend in the region 812. Further, the cavities 815 and channels 817 of flex nipple 810 may be packed with grease, to facilitate bending and to provide lubrication in view of the friction generated by the cavities 815.

Further downstream of the flex nipple 810, the bent nipple 820 is surrounded by a flex nipple sub-assembly 840, which is threadedly connected to the flex nipple 810. A bottom sub-assembly 850 is threadedly connected to the flex nipple sub-assembly 840. The connection between the flex nipple sub-assembly 840 and bottom sub-assembly 850 form a groove 809, with a ring 807 positioned in and registering with the groove 809. Here, the cross-section of the bottom sub-assembly 850 clearly illustrates the offset of the bent nipple 820 in the difference in thickness of the opposite sides of the bottom sub-assembly 850 that flank the bent nipple 820, at position 855, for example. The downstream end of the bottom sub-assembly 850 may be engaged with a suitable drill bit selected by a person of ordinary skill in the art. In operation, the drill tool 100 thus may be used to drill into a formation downhole and has the capability for a controlled change in the direction of drilling in situ. The controlled change in direction of drilling in situ may be determined by operators of the drill tool 100 at the surface of the wellbore.

It will be readily apparent to those skilled in the art that the general principles defined herein may be applied to other embodiments and applications without departing from the spirit and scope of the present invention. Having thus described the exemplary embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Many such variations and modifications may be considered desirable by those skilled in the art based upon a review of the foregoing description of preferred embodiments. Accordingly, it is contemplated that the appended claims will cover any such modifications or embodiments that fall within the true scope of the invention.

What is claimed is:

1. An adjustable drilling tool assembly comprising:

a startup and communications module;

an electronics module for providing information to the drilling tool;

a piston operably attached to a J-slot assembly;

a hydraulic valve assembly for providing a hydraulic fluid to a mid-assembly, the hydraulic valve assembly adapted to supply hydraulic pressure alternately to a first side and a second side of the piston, the hydraulic pressure for reciprocating the piston;

a mid-assembly comprising the J-slot assembly, the J-slot assembly incrementally rotatable in response to the reciprocation of the piston, the rotational position of the J-slot assembly determining the drilling angle of the drilling tool; and, an adjustable lower assembly for adjusting the angle of the drilling tool, an upstream end of the adjustable lower assembly engaged to the J-slot assembly, the adjustable lower assembly comprising a flex nipple with a plurality of laterally oriented cavities disposed therein and a bent nipple that selectively bends depending on the rotational position of the J-slot assembly.

2. The drilling tool assembly of claim 1 further comprising a transition sub-assembly for interconnecting the hydraulic valve assembly and mid-assembly.

3. The drilling tool assembly of claim 1 further comprising a safety release sub-assembly for connecting the mid-assembly with the adjustable lower assembly.

4. The drilling tool assembly of claim 1 wherein the J-slot assembly comprises a series of longitudinal slots parallel to the axis of rotation of the drilling tool assembly and interconnected by angular channels in sequential increments.

5. The drilling tool assembly of claim 4 wherein the J-slot assembly is engaged by a guide pin extending from the mid-assembly.

6. The drilling tool assembly of claim 4 wherein the J-slot assembly facilitates angular adjustment of the bent nipple incrementally from 1 to 3 degrees.

7. The drilling tool assembly of claim 4 wherein the J-slot assembly facilitates angular adjustment of the bent nipple between 1, 1.5, and 3 degrees.

8. The drilling tool assembly of claim 1 wherein the J-slot orientation is determined by a magnetic assembly.

9. The drilling tool assembly of claim 1 wherein the flex nipple is formed from a single contiguous material.

10. The drilling tool assembly of claim 1, the laterally oriented cavities of the flex nipple selectively interconnected by a plurality of lateral channels, the flex nipple able to be bent in the region containing the lateral cavities and channels.

11. The drilling tool assembly of claim 1 wherein the electronics module further comprises a magnetic sensor, a processor in communication with a memory, and a battery.

12. The drilling tool assembly of claim 1 wherein the startup module, electronics module, hydraulic valve assembly and adjustable bent lower assembly are interconnected in sequence.

13. A method for adjusting the drilling direction of a drilling tool assembly in situ comprising:

receiving a first hydraulic signal from an upstream source, activating an electronics module for controlling a hydraulic valve assembly;

reciprocating a hydraulically operated piston to rotate a J-slot assembly contained in a mid-assembly, the J-slot assembly rotatable in predetermined increments; and, bending a bendable sub-assembly to a predetermined angular position by bending a flex nipple based upon the rotational position of the J-slot assembly.

14. The method of claim 13, the drilling tool assembly controllable by the upstream source and able to send feedback information to the upstream source.

15. The method of claim 13 wherein the J-slot assembly comprises a series of longitudinal slots parallel to the axis of rotation of the drilling tool assembly and interconnected by angular channels in a sequential direction.

16. The method of claim 13 wherein the J-slot assembly is engaged by a pin extending from the mid-assembly, the pin engaging the longitudinal slots of the J-slot assembly as the J-slot assembly rotates in sequential increments.

17. The method of claim 13 wherein the rotational position of the J-slot assembly determines the drilling angle of the flex nipple incrementally from 1 to 3 degrees.

18. The method of claim 13 wherein the current rotational position of the J-slot assembly is determined by a magnetic assembly.

19. The method of claim 13 wherein the adjustable bent lower assembly further comprises a flex nipple form from a single contiguous part.

20. The method of claim 13 wherein the electronics module further comprises a magnetic sensor, a processor in communication with a memory, and a battery.

21. The method of claim 13 wherein the startup module, electronics module, hydraulic valve assembly and adjustable bent lower assembly are interconnected in sequence.

* * * * *